US005433235A

United States Patent [19]

Miric et al.

[11] Patent Number: 5,433,235

[45] Date of Patent: Jul. 18, 1995

[54] FOLDABLE AND LOCKABLE WALKER

[75] Inventors: Zivko Miric; Leo Zatulovsky, both of Northridge; Cuong Bui, Yorba Linda, all of Calif.

[73] Assignee: Guardian Products, Inc., Simi Valley, Calif.

[21] Appl. No.: 151,494

[22] Filed: Nov. 12, 1993

[51] Int. Cl.[6] ..... A61H 3/00

[52] U.S. Cl. ..... 135/67; 135/74; 135/65; 403/108

[58] Field of Search ..... 135/65, 67 OR, 74; 403/108, 325, 327

[56] References Cited

U.S. PATENT DOCUMENTS

| | | | |
|---|---|---|---|
| 2,996,070 | 8/1961 | Ries . | |
| 3,442,276 | 5/1969 | Edwards et al. . | |
| 3,690,652 | 9/1972 | Schneider . | |
| 3,945,389 | 3/1976 | Smith . | |
| 3,993,088 | 11/1976 | Thomas . | |
| 4,180,086 | 12/1979 | Thomas . | |
| 4,298,016 | 11/1981 | Garelick . | |
| 4,461,471 | 7/1984 | Brastow . | |
| 4,518,002 | 5/1985 | Battiston, Sr. et al. . | |
| 4,523,773 | 6/1985 | Holtz | 403/108 X |
| 4,830,035 | 5/1989 | Liu . | |
| 5,188,139 | 2/1993 | Garelick . | |
| 5,255,696 | 10/1993 | Leonard | 135/67 |

*Primary Examiner*—Carl D. Friedman
*Assistant Examiner*—Wynn E. Wood
*Attorney, Agent, or Firm*—Willian Brinks Hofer Gilson & Lione

[57] ABSTRACT

A foldable and lockable walker is disclosed that includes a pair of locking members provided on the cross-brace and cooperatively engaged to the horizontal portion of the side supports. The locking member receives a spring biased pin to lock the side supports against relative movement with respect to the cross-brace.

8 Claims, 2 Drawing Sheets

FOLDABLE AND LOCKABLE WALKER

BACKGROUND OF THE INVENTION

This invention relates to an improved foldable walker and particularly to a locking device for a foldable walker.

Although foldable walkers are known, there is a need for a foldable walker having a simple and effective means for locking the walker in an open position for use and for permitting the walker to be readily folded for storage and transport.

Several prior art walkers provide a pair of telescoping tubes with the inner tube carrying a spring biased pin that is received in an aperture provided in the outer to lock the inner tube with respect to the outer tube. U.S. Pat. No. 3,690,652, for example, provides sleeves (23, 25) to position a front cross-brace 20 on the legs (12) of the walker. The legs carry a spring biased key (30) that extends through slots (40 or 42) in the sleeves (23, 25) to lock the legs in position with respect to the front cross brace.

U.S. Pat. No. 3,993,088 shows a foldable walker having a telescoping bar (74) that includes an inner tube (76) telescoped within an outer tube (78). One end of the inner tube is riveted to the rear leg of the walker. The other end of the bar (74) is attached to the front cross brace. A spring loaded locking button (84) is provided on the inner tube (76) to engage an aperture in the outer tube (78) to lock the inner tube with respect to the outer tube and consequently to lock the side members of the walker in an open position.

U.S. Pat. No. 4,180,086 shows an improvement to U.S. Pat. No. 3,993,088 where the legs can be hyperextended and a palm pusher device (44) is provided to operate the spring biased locking button.

One problem with these and other walkers having telescoping tubes is that it requires additional parts and a complicated structure to attach the tubes to the rear legs or to joining members provided between the front and rear legs. Another problem is that the locking devices are inconveniently located making it difficult for the user to unlock the walker so that it can be folded for storage.

The present invention solves these problems by providing a foldable walker having a locking device with an easy to reach push button located on the front cross bar so that the legs can be unlocked from the open position.

SUMMARY OF THE INVENTION

The present invention provides a foldable walker adapted to fold to a collapsed state and to unfold to a rigid unfolded state. The walker comprises a first substantially U-shaped side support that defines a first front leg and a first rear leg joined at their upper ends by a first horizontal portion and a second substantially U-shaped side support that defines a second front leg and a second rear leg joined at their upper ends by a second horizontal portion. A cross-brace connects the first and second front legs and carries a first and a second spring biased pin. A first slidable locking member is provided on the cross-brace and cooperatively engages the first horizontal portion with the locking member receiving the first spring biased pin to lock the cross-brace and the first side support against relative movement. A second slidable locking member is provided on the cross-brace and cooperatively engages the second horizontal portion with the locking member receiving the second spring biased pin to lock the cross-brace and the second side support against relative movement.

The present invention also contemplates a locking member associated with tube carrying a spring biased pin that is particularly useful with the foldable walker of the present invention. The locking member includes a collar that surrounds the tube carrying the spring biased pin. The collar to sized to allow the locking member to slide along the tube. The locking member has a channel to receive and guide the spring biased pin to a shaft extending from the locking member such that when the shaft receives the pin, the locking member is locked from sliding movement along the tube. Preferably, the channel has a cammed surface that will contact the pin and depress the pin as the lock nears the shaft. A pusher is provided on the locking member with a portion disposed within the shaft so that as the pusher is depressed the pin is depressed and the locking member is unlocked to slide along the tube.

DETAILED DESCRIPTION OF THE DRAWINGS

DETAILED DESCRIPTION OF THE PREFERRED EMBODIMENTS

Figure 1:
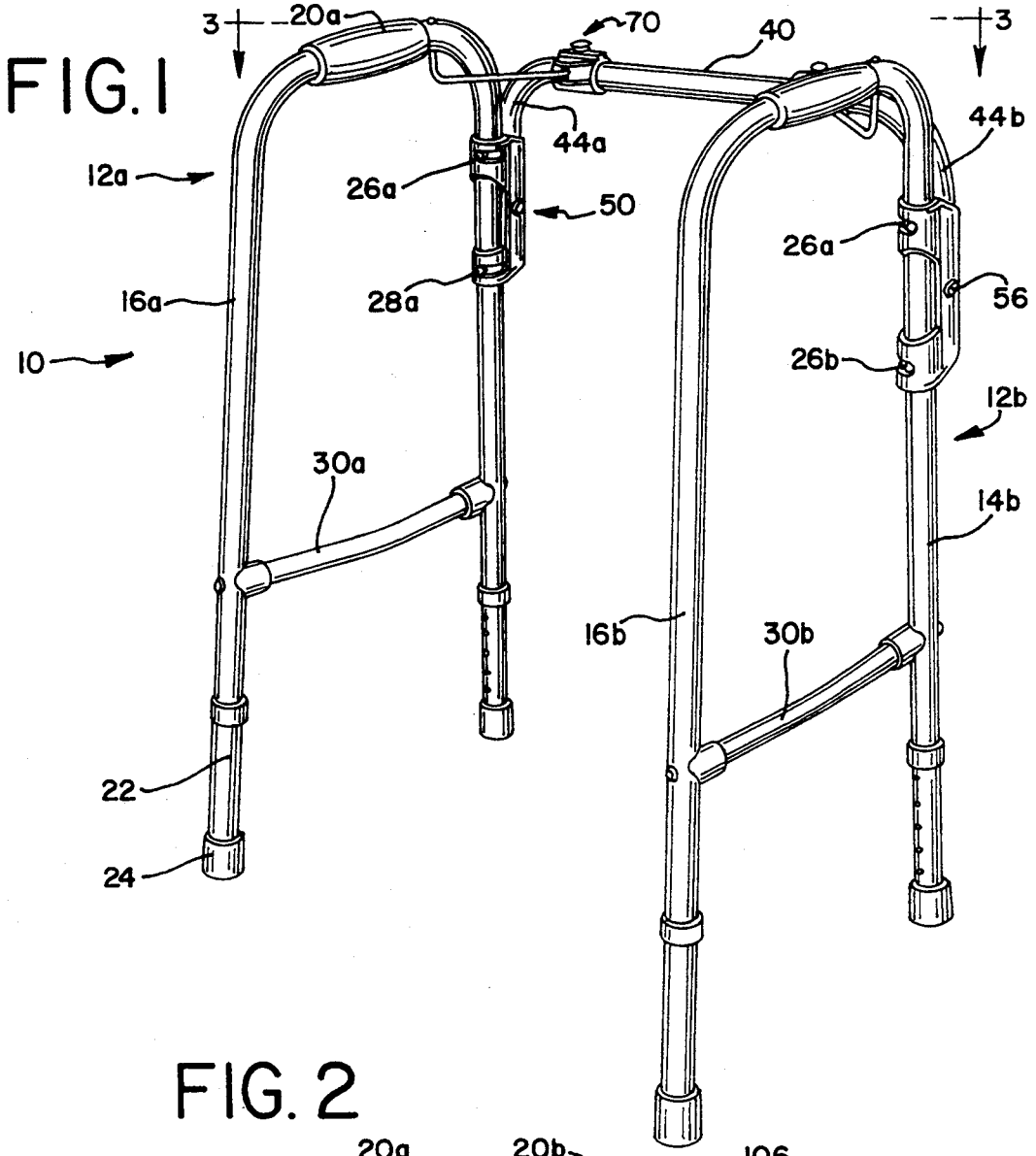
FIG. 1 is a perspective view showing the foldable walker locked in an open position.

FIGS. 1 through 4 show a preferred embodiment of the walker of the present invention. FIG. 1 shows the walker 10 locked in the open position. The walker 10 comprises a first side support **12*a* and a second side support 12*b*. The first side support 12*a* is generally U-shaped to define a first front leg 14*a* and a first rear leg 16*a* joined at their upper ends by a horizontal portion 18*a*. The horizontal portion 18*a* preferably carries a hand grip 20*a*** to provide a gripping surface for the user.

The second side support **12*b* is spaced from and generally parallel to the first side support 12*a* when the walker 10 is in the open position. Like the first side support 12*a*, the second side support 12*b* is generally U-shaped to define a second front leg 14*b* and a second rear leg 16*b* joined at their upper ends by a horizontal portion 18*b*. The horizontal portion preferably carries a hand grip 20*b*** to provide a gripping surface for the user.

The lower portions of the legs **14*a*, 14*b*, 16*a*, and 16*b* are preferably provided with an adjustable leg portion 22 having a tip 24, preferably of rubber or other conventional non-slip material, coveting the end of the leg portion 22. The leg portions 22 are adjusted by using a spring biased pin extending through apertures in the lower portion of the legs 14*a*, 14*b*, 16*a* and 16*b*** as is well known by those skilled in the art.

The front legs **14*a* and 14*b* may be connected to the rear legs 16*a* and 16*b*, by vertical supports 30*a* and 30*b*, respectively, to provide further rigidity to the walker 10**.

A cross-brace 40 connects the first front leg 14*a* to the second front leg 14*b*. Preferably, the cross-brace 40 connects the front legs 14*a* and 14*b* so that the walker 10 can be folded to a collapsed state (see FIG. 2) and unfolded to an unfolded state (see FIG. 1). In particular, the cross-brace 40 connects the front legs 14*a* and 14*b* so that the side supports 12*a* and 12*b* can pivot or rotate with respect to the cross-brace.

In a preferred embodiment, the cross-brace 40 has a generally horizontal segment 42 that terminates at its ends with a first vertical segment 44*a* and a second vertical segment 44*b*. The first vertical segment 44*a* is parallel to and adjacent the first front leg 14*a* with the front leg 14*a* being pivotally joined to the first vertical segment 44*a* to allow the side support 12*a* to rotate with respect to the cross-brace 40. The second vertical segment 44*b* is parallel to and adjacent the second front leg 14*b* with the side support 12*b* being pivotally joined to the second vertical segment 44*b* to allow the side support 12*b* to rotate with respect to the cross-brace 40.

A pair of identical couplings 50 are provided to pivotally join the front legs 14*a* and 14*b* to the vertical segments 44*a* and 44*b* of the cross-brace. Each coupling 50 has a pair of vertical passageways 52 and 54 to receive the vertical segment 44*a* and 44*b* and the front legs 14*a* and 14*b*, respectively. Passageway 52 is sized to snugly receive the vertical segment 44*a* and 44*b*. A rivet or pin 56 is inserted radially through the coupling into the passageway 52 to pierce through the vertical segment 44*a* and 44*b*. Preferably, the rivet or pin 56 extends through opposite walls of the passageway 52 and, in turn opposite walls of the vertical segment 44*a* and 44*b* to fully secure the vertical segment from longitudinal and rotational movement within the passageway 52.

Passageway 54 is sized to snugly receive yet allow rotational movement of the front legs 14*a* and 14*b*. To secure the front legs 14*a* and 14*b* and consequently the side supports 12*a* and 12*b* from vertical movement with respect to the cross-brace 40, the coupling 50 is provided with at least one, preferably two, horizontal channels to receive a stud provided on the front leg. Preferably, the coupling 50 has an upper horizontal channel 58 and a lower horizontal channel 60 to receive an upper stud 26*a* and a lower stud 26*b*, respectively, provided on each of the front legs 14*a* and 14*b*.

Figure 2:
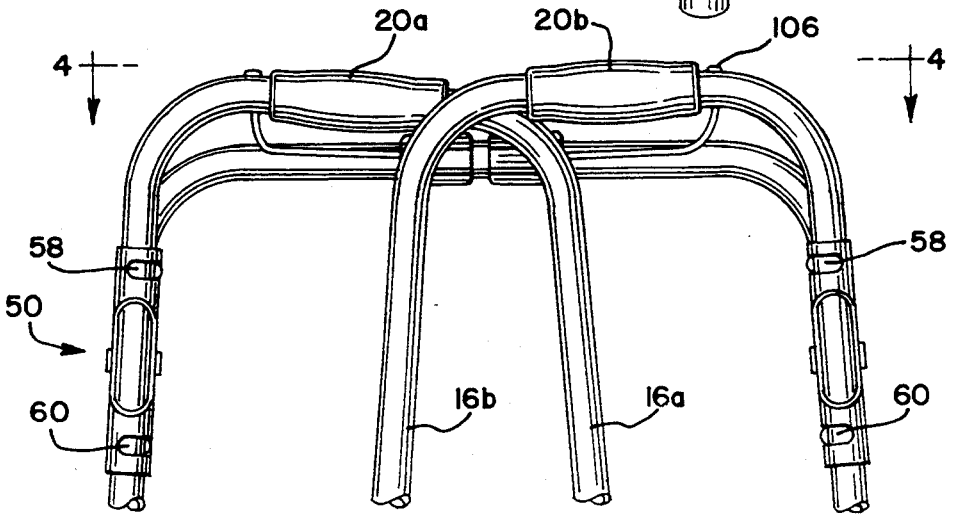
FIG. 2 is a partial perspective view showing the foldable walker in a folded position.
Figure 3:
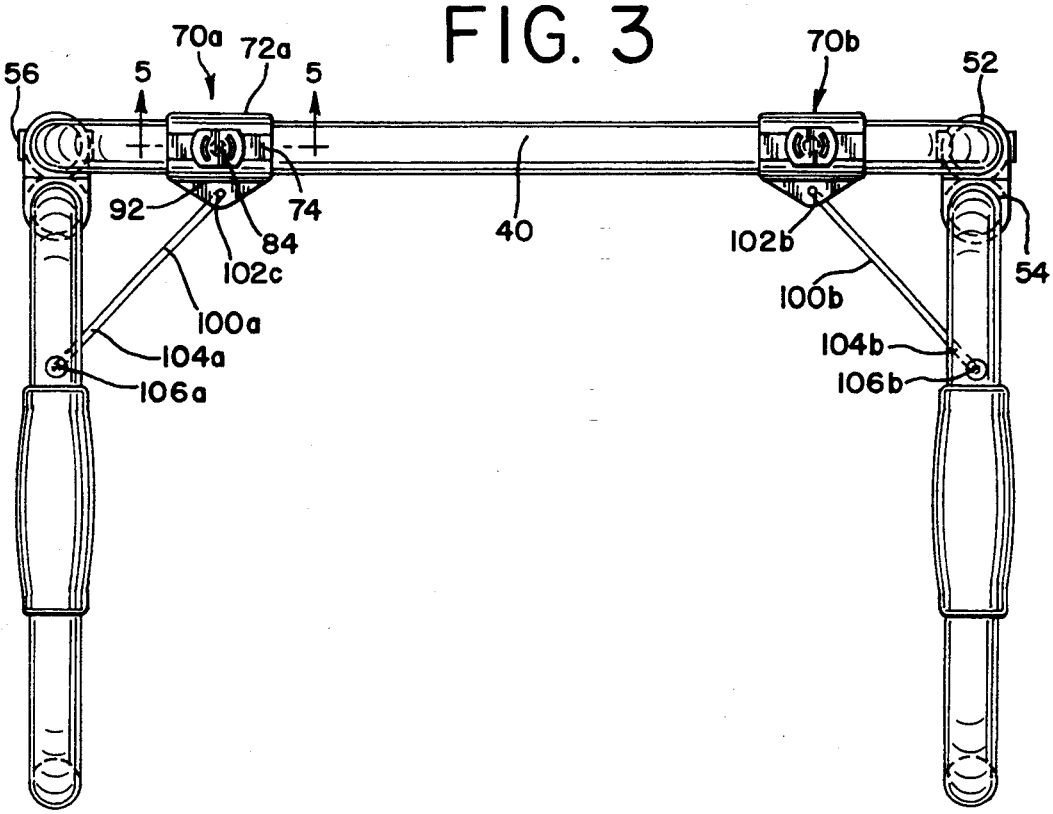
FIG. 3 is a top view showing the foldable walker locked in an open position.

The channels 58 and 60 can extend any peripheral distance around the coupling to provide for a desired open position to a closed position. For example, if it was desired to place the side supports at about a ninety degree angle with respect to the cross-brace, the channels 58 and 60 would extend around the coupling approximately ninety degrees as best seen in FIGS. 1 and 2. If, however, it was desired to provide a hyper-extended position, where the side supports are placed at an angle greater than about ninety degrees with respect to the cross-brace, the channels 58 and 60 would then extend around the coupling more than about ninety degrees to the desired angular location.

A first locking member 70*a* and a second locking member 70*b* are provided to lock the first and second side supports, respectively, against relative movement with respect to the cross-brace 40, as best seen in FIG. 1. Since the locking members 70*a* and 70*b* are identical, only the construction and function of locking member 70*a* will be described with the understanding that the same structural and functional aspects correspondingly apply to locking member 70*b*.

Figure 5:
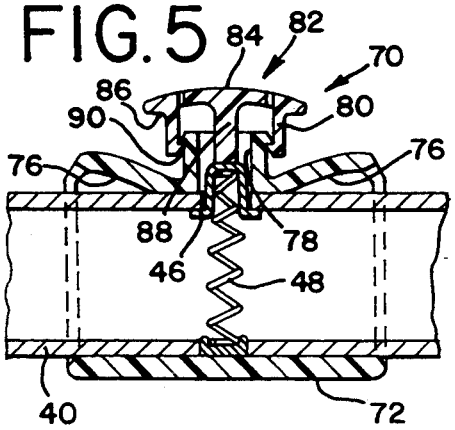
FIG. 5 is a cross sectional view of the locking mechanism of the present invention along 5—5 of FIG. 3.
Figure 6:
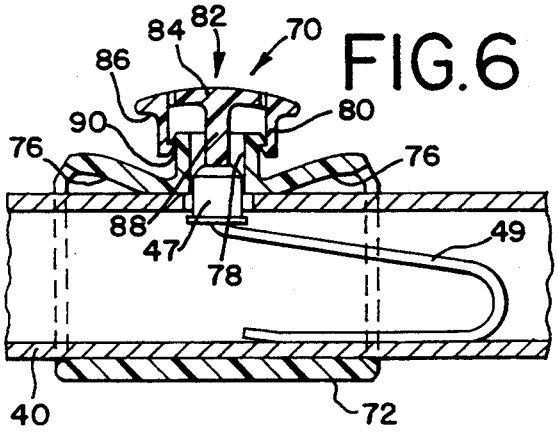
FIG. 6 is a cross sectional view of an alternative embodiment of the locking mechanism of the present invention.

The locking member 70 is slidably received on the horizontal segment 42 of the cross-brace and is cooperatively engaged to the horizontal portion 18 of the side support 12. As best seen in FIG. 5, the locking member 70 receives a spring biased pin 46 provided on the horizontal segment 42 of the cross-brace to lock the cross-brace and side support against relative movement. The spring biased pin 46 is preferably biased upwardly by a spring 48 through an aperture provided in the horizontal segment 42. Alternatively, as shown in FIG. 6, a pin 47 may be biased upwardly by spring 49 through an aperture provided in the horizontal segment.

Figure 4:
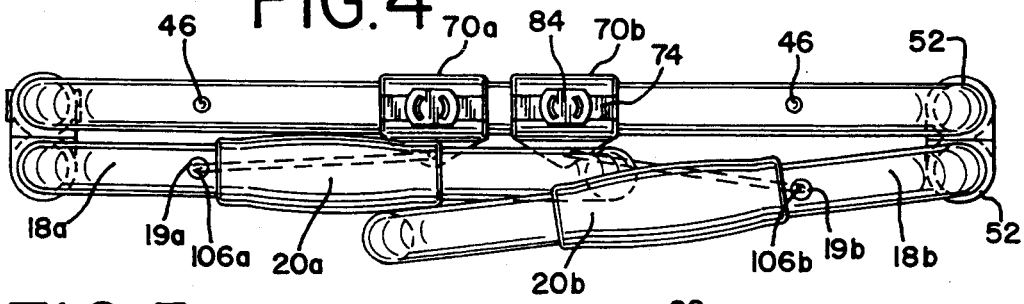
FIG. 4 is a top view showing the foldable walker in a folded position.

The locking member 70 includes a shaft 78 that receives the spring biased pin 46 to secure the locking member and thus the side support 12 in position. Preferably, the locking member includes a collar 72 that surrounds the horizontal segment 42 yet allows the locking member to slide along the length of the horizontal segment 42. When the walker 10 is in a folded position as best seen in FIG. 4, the locking member 70 is located at about the midpoint of the horizontal segment 42 between the first and second vertical segments. Desirably, the spring biased pin 46 extends upward from the top of the vertical segment. In this position, the locking member 70 has a channel 74 provided on its upper surface to receive and guide the pin 46 to the shaft 78 in the locking member. Preferably, the channel 74 has an upper cammed surface 76 that depresses the pin 46 as the pin nears the shaft 78. When the pin 46 is directly below the shaft 78, which is sized slightly larger than the pin 46, the pin 46 is biased upward by the spring 48 into the shaft 78 to lock the locking member 70 in position. Since the locking member 70 is cooperatively engaged to the horizontal portion 18 of the side support 12, the side support is locked against relative movement with respect to the cross-brace 40.

Desirably, the locking member 70 is provided with pusher 82 surrounding the shaft 78 and having a head 84 preferably with grippers 86 and a plunger 88. The plunger 88 extends into the shaft 78 and contacts the pin 46 so that when the head 84 is depressed, the plunger 88 depresses the pin 46 so that the locking member 70 can slide away from the pin 46. In this way, the user can easily unlock the locking member 70 to fold the walker. Preferably, at least a portion of the outer circumference of the shaft 78 has lips 80 to engage lips 90 provided on the pusher 82 to act as a stop to prevent the pusher 82 from becoming disengaged from the locking member 70.

In the most preferred embodiment, the shaft 78 of the locking member 70 is provided at about the midpoint between the two longitudinal ends of the locking member. In this embodiment, two channels 74 are provided, extending from each end toward the shaft 78. It will be understood that the locking member can then slide in either direction away from the pin 46.

To cooperatively engage the locking member 70 to the horizontal portion 18, a rod 100 is provided with a first end pivotally received by the locking member 70 and a second end pivotally received by the side support, preferably the horizontal portion of the side support. Since two locking members 70*a* and 70*b* are provided, two rods 100*a* and 100*b* are provided and are identical. Only the construction and function of rod 100*a* will be described with the understanding that the same structural and functional aspects correspondingly apply to rod 100*b*.

Rod 100*a* has a first end 102*a* that pivotally engages the locking member 70*a* and a second end 104*a* that pivotally engages the side support 12*a*, preferably the horizontal portion 18*a*. Preferably, the locking member 70*a* has a rearward extending flange to pivotally engage the first end of the rod 102. More preferably, the locking member 70*a* has an upper flange 92 and a lower flange 96 each having an aligned aperture 94 and 98, respectively. The first end of the rod 102 is flattened to fit between the upper and lower flanges. An aperture is provided in the first end of the rod 102. In this way a rivet or pin extending through the apertures 94, 98 and in the first end of the rod, can be used to pivotally secure the rod 100 to the locking member 70.

The second end of the rod 104 is curved vertically upward to be pivotally received by the horizontal portion 18. Preferably, a receiving member 106 is rotatably secured within an aperture 19 provided on the horizontal portion. More preferably, the aperture 19 is provided forward of the hand grip 20. The second end 104 of the rod is fixed to the receiving member 106 so that the locking member 70 is cooperatively engaged to the horizontal portion.

The locking member 70*b* is cooperatively engaged to the horizontal portion 18*b* of the side support in the same fashion as described above for the locking member 70*a*.

The present invention also contemplates a locking member associated with a spring biased pin that is particularly useful with the foldable walker of the present invention. Referring to FIG. 5, a locking member 70 is shown having a collar 72 slidably surrounding a tube 40 that carries a spring biased pin 46 that is biased through an aperture in the robe 40 by a spring 48. The locking member 70 has a channel 74 preferably with a cammed surface 76 to receive and guide the pin 46 to a shaft 78 in the locking member. It will be appreciated by one skilled in the art, that as the pin 46 nears the shaft 78 it is depressed by the cammed surface 76 until the pin reaches the shaft where it is biased into the shaft to lock the locking member 70 from slidable movement away from the pin.

To disengage the locking member 70 from the pin 46, a pusher 82 is provided on the locking member and has a portion extending into the shaft 78 so that when the pusher is depressed, the pin is depressed and the locking member can be slidably moved away from the pin. Preferably, the pusher 82 is provided with a head 84 having grips 86 and a plunger 86 extending into the shaft 78 to contact the pin. The outer circumference of the shaft 70 has lips 80 to engage lips 90 provided on the pusher 82 to act as a stop to prevent the pusher 82 from becoming disengaged from the locking member 70.

In a preferred embodiment, the shaft 78 of the locking member 70 is disposed at about the midpoint between the two longitudinal ends of the locking member. In this embodiment, two channels 74, each preferably having a cammed surface 76, are provided. As a result, the locking member can then slide in either direction away from the pin 46.

It is apparent from the foregoing that various changes and modifications may be made to the foldable walker including the locking member according to the present invention without departing from the scope thereof. Accordingly, the scope of the invention should be limited only by the appended claims wherein

What is claimed is:

1. A foldable walker adapted to fold to a collapsed state and to unfold to a rigid unfolded state comprising:

a. a first substantially U-shaped side support that defines a first front leg and a first rear leg joined at their upper ends by a first horizontal portion;

b. a second substantially U-shaped side support that defines a second front leg and a second rear leg joined at their upper ends by a second horizontal portion;

c. a cross-brace connecting the first and second front legs and carrying a first and a second spring biased pin;

d. a first slidable locking member provided on the cross-brace and cooperatively engaged to the first horizontal portion, the locking member receiving the first spring biased pin to lock the cross-brace and the first side support against relative movement; and, e. a second slidable locking member provided on the cross-brace and cooperatively engaged to the second horizontal portion, the locking member receiving the second spring biased pin to lock the cross-brace and the second side support against relative movement.

2. The walker of claim 1 wherein the first locking member has a shaft to receive the first spring biased pin to lock the cross-brace and the first side support against relative movement and the second locking member has a shaft to receive the second spring biased pin to lock the cross-brace and the second side support against relative movement.

3. The walker of claim 2 wherein the first locking member has a longitudinal channel to guide the first spring biased pin to the shaft and the second locking member has a longitudinal channel to guide the second spring biased pin to the shaft.

4. The walker of claim 3 wherein the channel in the first locking member and the second locking member is cammed so that as the pin nears the shaft it is depressed.

5. The walker of claim 2 wherein the first locking member further has a pusher with a portion disposed in the shaft such that when the pusher is depressed it contacts and depresses the first spring biased pin to allow the first side support to be moved relative to the cross brace and the second locking member further has a pusher with a portion disposed in the shaft such that when the pusher is depressed it contacts and depresses the second spring biased pin to allow the second side support to be moved relative to the cross brace.

6. The walker of claim 1 further having a first connecting rod cooperatively engaging the first locking member to the first horizontal portion and a second connecting rod cooperatively engaging the second locking member to the second horizontal portion.

7. The walker of claim 1 wherein the cross-brace has a generally horizontal segment terminating with a first and a second vertical segment at each end, the first vertical segment parallel to and adjacent the first front leg and the second vertical segment parallel to and adjacent the second front leg, the first front leg being pivotally joined to the first vertical segment by a first coupling and the second front leg being pivotally joined to the second vertical segment by a second coupling.

8. The walker of claim 7 wherein each coupling comprises a pair of parallel spaced apart passageways with the vertical segment fixed in one of the passageways and the front leg movably engaged in the other passageway.

* * * * *